United States Patent [19]

Hughes

[11] 4,120,334

[45] Oct. 17, 1978

[54] ONE OPERATOR SHAKE SPLITTING APPARATUS

[75] Inventor: John H. Hughes, Aberdeen, Wash.

[73] Assignee: J. H. Hughes, Inc., Montesano, Wash.

[21] Appl. No.: 770,567

[22] Filed: Feb. 22, 1977

[51] Int. Cl.[2] ..... B27L 7/00

[52] U.S. Cl. ..... 144/326 R; 144/13; 144/193 J; 83/870

[58] Field of Search ..... 144/13, 193 R, 193 J, 144/193 K, 194, 195, 326 R; 254/DIG. 6; 83/4

[56] References Cited

U.S. PATENT DOCUMENTS

| | | | |
|---|---|---|---|
| 439,224 | 10/1890 | Williams | 144/13 |
| 2,094,640 | 10/1937 | Koster et al. | 144/193 J |
| 2,128,521 | 8/1938 | Beckman | 144/193 J |
| 2,201,815 | 5/1940 | Hendricks et al. | 144/193 J |
| 2,616,461 | 11/1952 | Bearce | 144/194 X |
| 2,771,107 | 11/1956 | Vasey | 144/193 J |
| 3,776,287 | 12/1973 | Hughes | 144/326 R X |

*Primary Examiner*—Gil Weidenfeld

*Assistant Examiner*—W. D. Bray

*Attorney, Agent, or Firm*—Seed, Berry, Vernon & Baynham

[57] ABSTRACT

A single operator shake mill having a frame adjoining a workman operating station is provided with a surface for supporting a pre-kerfed shake block. A stop member is inclined upwardly and rearwardly toward the operator station to apply a downward and rearward force on the block whereas a splitting bar at the operator station is pulled through a kerf in the block to split an uppermost shake from the block by the application of a downward and forward pulling force which holds the block tight against the stop member and supporting surface while splitting. A reversible motor rotates sprockets which pull chains connected to the forward end of the splitting bar for providing the pulling force on the splitting bar. The control for this motor is at the operator's station so that the operator is free to set the block in place, split the shakes, and trim and stack the shakes without leaving the operator station. A shake trimming apparatus is also shown.

11 Claims, 6 Drawing Figures

ONE OPERATOR SHAKE SPLITTING APPARATUS

BACKGROUND OF THE INVENTION

1. Field of the Invention

This invention pertains to shake splitting apparatus and methods and more particularly to apparatus and methods wherein a single operator can perform the feeding, splitting, trimming and stacking of split shakes all at a single operating station.

2. Description of the Prior Art

Various types of shake splitting mills and methods have been employed in the past. Except for totally manual splitting techniques where a workman takes a shake bolt or block and with a hammer and froe splits each shake from the bolt, all of the systems have mechanized to some extent the shake splitting operation. The manual shake splitting technique is undesirable because the splits must follow exactly the irregularities of the grain of the wood, the process is very slow, tiresome to the workman, and generally is very disorganized with the split and untrimmed shakes lying in disarray around the working area.

Many of the difficulties of manual shake splitting are eliminated by mechanized techniques which start a split in the sawn kerf. U.S. Pat. Nos. 3,805,861, RE. 28,583 and 3,776,287 are representative. In these mechanized techniques, however, the workman had no control over the separation of the shake from the block thus requiring piecemeal separate operations and the various operations frequently involved different workmen.

Trimmers for trimming shakes to width and length are usually powered and create a safety problem in shake mills.

SUMMARY OF THE INVENTION

It is an object of this invention to provide a method and apparatus for the splitting, trimming and stacking of shakes all at a single operating station.

It is another object of this invention to provide a simplified and inexpensive manually controllable shake splitting apparatus.

Basically, these objects are obtained by positioning an operating station for feeding a block and trimming and stacking split shakes at the splitting location of a shake splitting apparatus. The apparatus includes a pre-kerfed bolt or block supporting surface, a stop member for stopping movement of the block and applying a downward pressure thereon, splitting means for applying a downwardly and forwardly directed splitting force to separate an endmost shake from the block. The splitting means includes a splitting bar which is manually guided and controled by the operator at the operating station with the split shakes being manually handled from the operating station and trimmed and placed in one or more adjacent stacking bins dependent upon the dimensions and/or quality of the shakes. In the preferred embodiment the splitting bar is pulled downwardly as well as toward the stop member to maintain downward pressure on the block during the splitting. The splitting bar is preferably connected to flexible chains at its opposite forward ends and drawn through the block by a reversible motor the operation of which is also controlled at the operator station.

Several advantages of the method and apparatus are that the apparatus can be inexpensively constructed and be operated by a single workman without leaving the operating station. Since all of the operations occur at one station the operator can increase his productivity and have complete control over the quality and quantity of the shakes under his responsibility. The invention represents a one workman mill and as a result, higher quality shakes can be produced in a shorter period of time and with safer conditions than exist in fully mechanized shake mills.

Another feature of the invention is an improved shake trimming apparatus which is inexpensive to build and safe.

DETAILED DESCRIPTION OF THE PREFERRED EMBODIMENT

Figure 1:
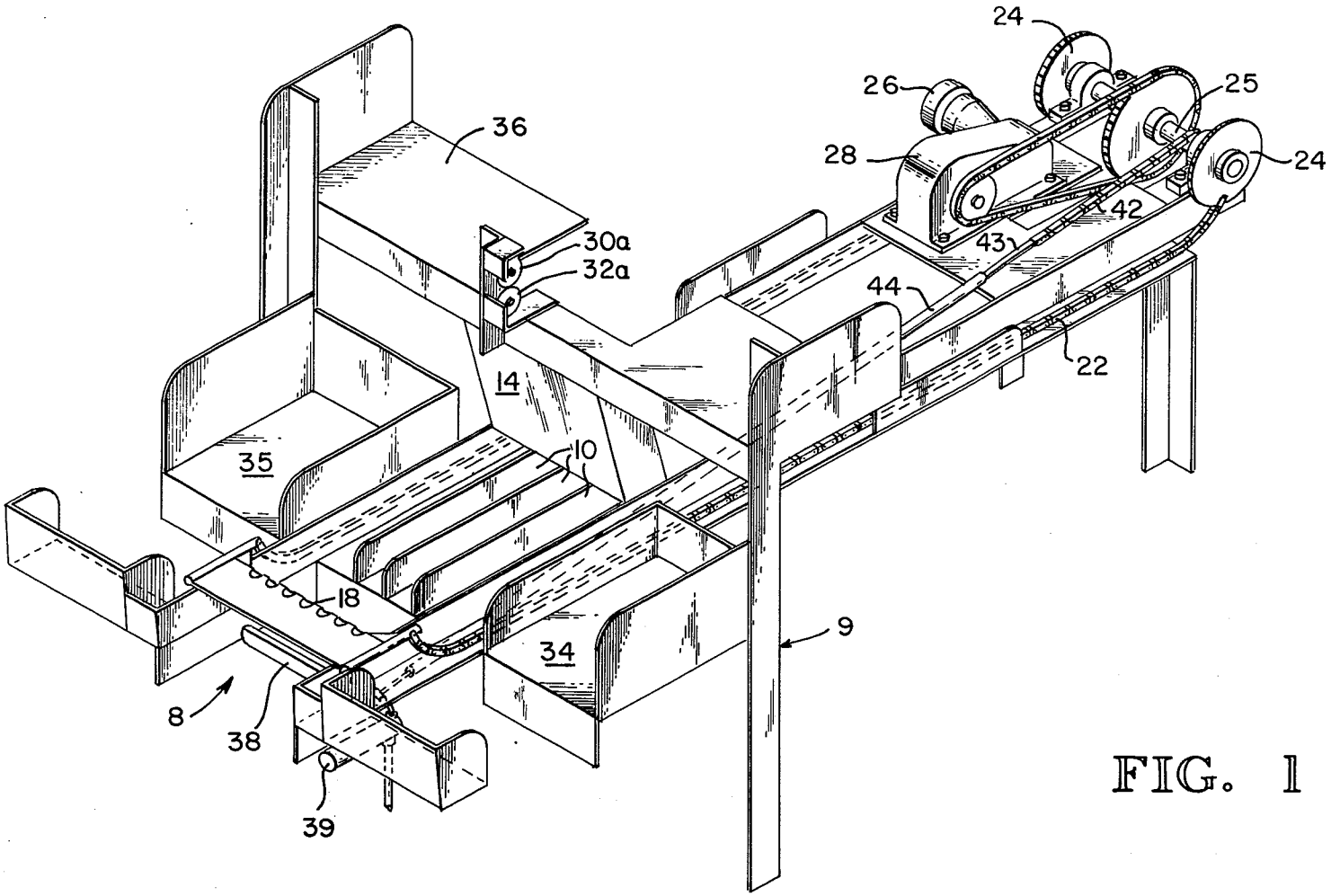
FIG. 1 is an isometric of a shake splitting apparatus embodying the principles of the invention.

As best shown in FIG. 1 an operator's station 8 adjoins a framework 9. The framework has a block supporting surface comprised of a plurality of vertical plates 10. The spacing between the vertical plates allows the shake block to be positioned so that irregularities in the exterior surface of the block can be accommodated so that the kerfs in the shake lie generally in horizontal planes. A typical pre-kerfed block B is shown having saw cuts or kerfs 12 each of which form the tip end portion of a shake. The natural grain lines of the split shake form the thicker weather end of the shake.

Figure 4:
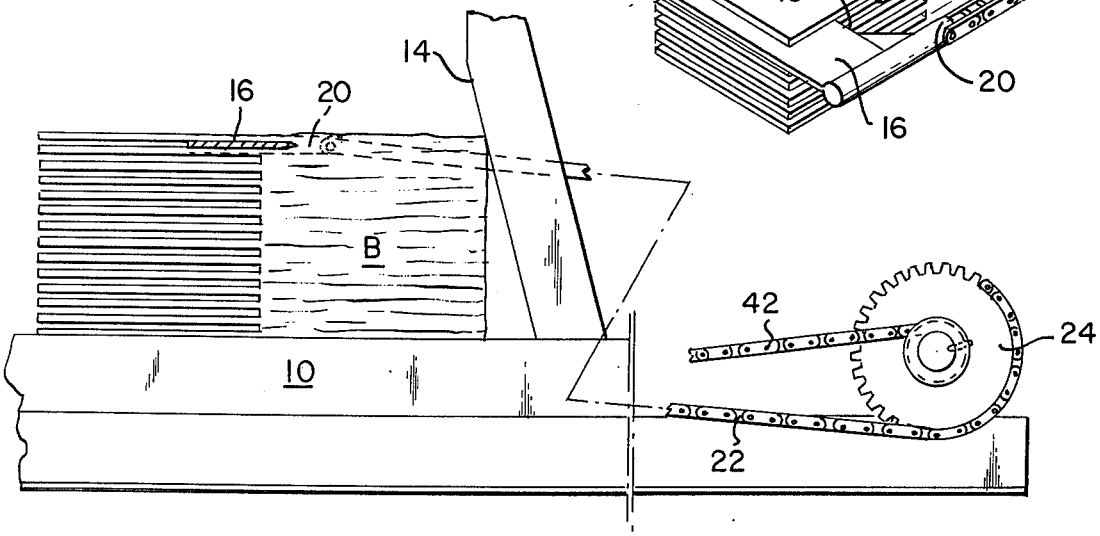
FIG. 4 is a fragmentary vertical section taken of the apparatus shown in FIG. 1.

Positioned on the frame at the forward end (to the right in FIG. 1 in relation to the operator's station) of the plates 10 is a stopping plate 14. As best shown in FIG. 4, the stopping plate is inclined upwardly and rearwardly or to the left as viewed in FIG. 4. The plate provides a downwardly imposed reaction force on the block against the splitting force to assure that the block does not flip-up under the splitting force. The rearward inclination also accommodates varying inclinations of the ends of the shake blocks which frequently are not perpendicular with the underside of the shake block.

The means for splitting the shakes will now be described and includes a splitting bar 16 having a forward sharpened edge 18 and a pair of bars or posts 20 which extend forwardly and are connected to chains 22 which are connected to a set of sprockets 24. The sprockets are keyed to a shaft 25 that is rotated by a reversible air motor 26 and a drive transmission 28. The lower peripheral surface of each of the sprockets 24 is located below the upper surfaces of the support plates 10 so that upon application of a pulling force in the chains 22 the splitting bar is pulled forwardly as well as simultaneously downwardly to maintain the forces on the shake block in a downward direction to seat the block firmly on the support surfaces 10. Rotation of the sprockets 24 in the counter-clockwise direction as viewed in FIG. 4 will pull the chains 24 and thus the splitting bar through the block B. Reverse or clockwise rotation of the sprockets 24 will unwrap the chains from the sprockets allowing them to slacken so that the workman at the operating station can manually pull the splitting bar back to the operating station in position for the next split.

The knife edge 18 on the splitting bar severs the block during the beginning of the split but thereafter the splitting bar pries or wedges the split open through the end of the block. It should be understood, however, that the splitting bar is free to move vertically so that it can follow the grain rather than shear through the weather end of the block. Finally, the workman manually lifts the shake free from the block.

Figure 5:
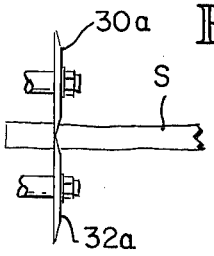
FIG. 5 is a fragmentary elevation illustrating a preferred shake trimmer used on the apparatus of FIG. 1.

After a shake is removed, the workman can trim the side or end edges to desired dimensions by a pair of trimming blades 30*a* and 32*a*. As best shown in FIG. 5 the peripheral cutting edges of the blades are aligned and opposed so that a shearing action occurs merely by pushing a shake S through the blades. The blades are not powered and are driven solely by the workman pushing the shake through the blades. After the shake is trimmed it is then placed in one of several bins 34, 35, or 36 depending upon its size and quality. All of these bins are within easy reach of the workman while standing at the operator station 8.

Figure 2:
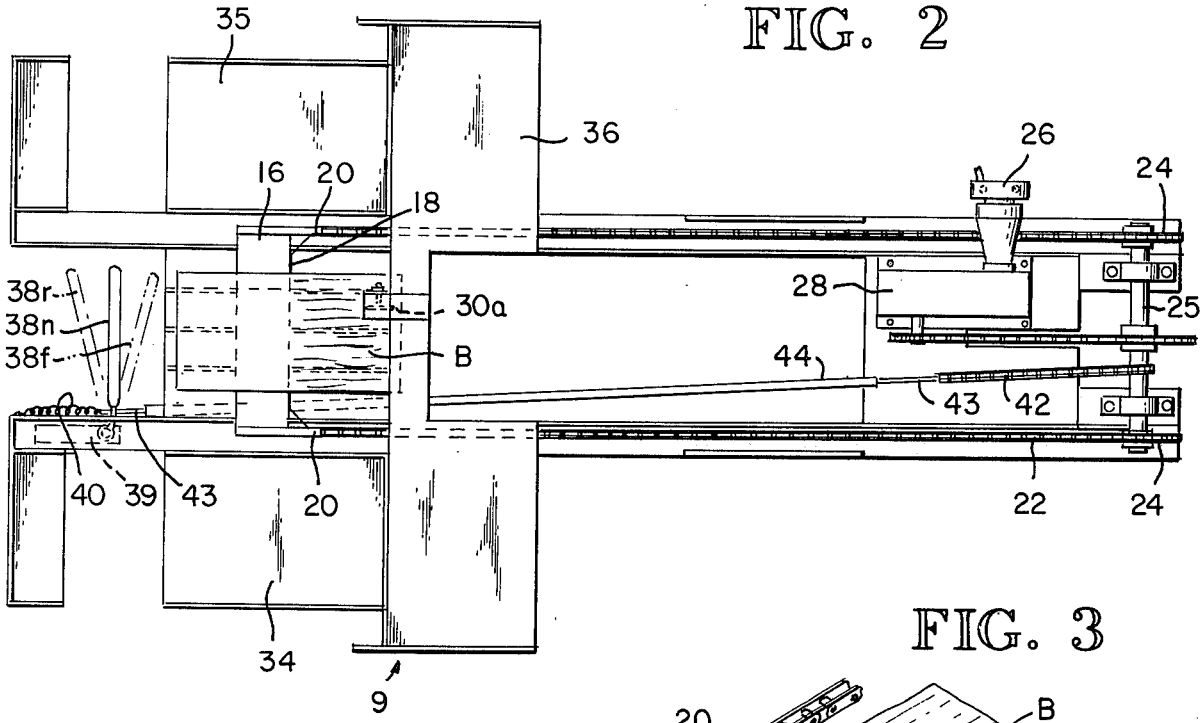
FIG. 2 is a plan view of the apparatus shown in FIG. 1.
Figure 3:
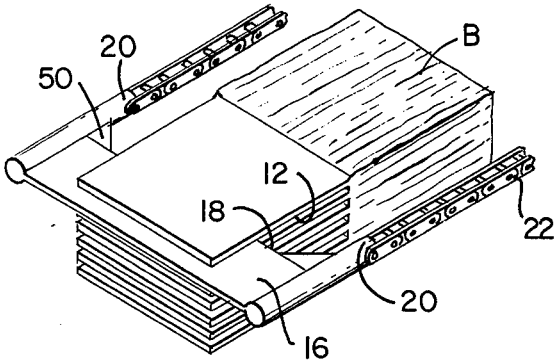
FIG. 3 is an isometric of a splitting bar engaged within a pre-kerfed block embodying the principles of the invention.

In order to control the power driven movement of the splitting bar 16 the operator station 8 is provided with a valve actuating paddle 38. The paddle moves the operator of an air valve 39 to a forward position by forward movement of the paddle as shown by the character 38*f* in FIG. 2, a rearward or reverse position shown by the reference character 38*r* in FIG. 2 or a neutral position as shown by the reference character 38*n* in FIG. 2. The forward position, of course, causes rotation of the sprockets 24 in the counter-clockwise direction to effect a splitting action by the splitting bar. The reverse position directs air in the opposite direction through the motor 26 to allow the sprockets to unwind and cause slack in the chains 22. The neutral position blocks air from entering the motor 26 so that the sprockets remain stationary. A spring 40 returns the paddle to the rearward position. The paddle is returned to the neutral position by a flexible chain 42. The chain 42 is coupled to a shaft 43 that is guided in a pipe 44. The shaft 43 also connects to the paddle 38 whereas the chain 42 is wrapped around and fixed to the shaft 25. During a counter-clockwise rotation of the sprockets 24 when the splitting bar is pulled through the block the chain 42 unwraps and falls slack. During the reverse operation of the sprockets 24, however, when the chains 22 are going slack the chain 42 is again wrapped on the shaft 25 until it becomes tight and then moves the paddle 38 from its reverse position toward the neutral position. When the paddle reaches the neutral position the valve 39 is closed and the air motor 26 stops thus resetting the machine in a passive condition ready for the next splitting operation.

Figure 6:
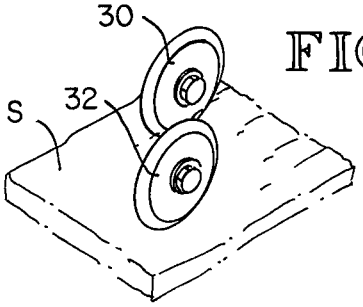
FIG. 6 is an isometric of a second shake trimming apparatus.

An alternate form of trimming apparatus is shown in FIG. 6 and includes two unpowered cutting discs 30 and 32 having inclined overlapping cutting edges for shearing the ends and side edges of the shakes.

While the preferred embodiments of the invention have been illustrated and described it should be understood the variations will be apparent to one skilled in the art without departing from the principles herein. Accordingly the invention is not to be limited to the specific embodiment illustrated in the drawing.

I claim:

1. A shake splitting apparatus for splitting shakes from a pre-kerfed shake block comprising:

a block support surface, means on said support surface for blocking movement of the block along the support surface, splitting means having a forward end for slicing into the inner end of a kerf in a block resting on the surface against the blocking means, and means for pulling said splitting means toward said blocking means for splitting a shake free of said block, said pulling means including flexible tension means coupled to said forward end of the splitting means and positioned below said forward end whereby the forward end of the splitting means applies both a splitting force and a downward force for holding the block on the support surface during splitting.

2. The apparatus of claim 1, said blocking means being inclined rearwardly and upwardly toward said splitting means for applying a downward reaction force on said block.

3. A shake splitting apparatus for splitting shakes from a pre-kerfed shake block comprising:

a block support surface, means on said support surface for blocking movement of the block along the support surface, splitting means for slicing into the inner end of a kerf in a block resting on the surface against the blocking means, and means for pulling said splitting means toward said blocking means for splitting a shake free of said block, said means for pulling the splitting means including means for applying a force also toward the support surface for holding the block against the support surface, said means for moving said splitting means including a reversible motor, control means for actuating said motor, sprocket means rotated by a shaft coupled to said motor, and chain means coupled to said sprockets and opposite transverse forward ends of the splitting means.

4. The apparatus of claim 3, said control means including a hand operated control handle, a control valve for actuating the motor, and a flexible member coupled to said sprocket shaft and operable upon reversing said motor to deactuate the valve and stop the motor.

5. A single operator shake mill for splitting shakes from a pre-kerfed block comprising:

frame means, a workman operating station adjoining the frame means, block supporting means on the frame means at the operating station for supporting a pre-kerfed block with the kerfs facing the operating station, stop means on the supporting means for precluding forward movement of the shake block on the block supporting means, splitting means including a splitting knife movable from said operating station forwardly toward said stop means for entering a kerf on the block and splitting an exposed shake from the block, and means for driving the splitting knife into the block and releasing the splitting bar for return to the operating station, whereby a workman can feed blocks, split the shakes and remove the split shakes for bundling all at a single station, said splitting knife lying in a generally horizontal plane, said knife driving and releasing means including flexible tension members attached at forward ends of the splitting knife, means for pulling the tension members at a downward inclination whereby the splitting knife enters each uppermost kerf on the block and applies both a splitting force and a downward force for holding the block down on the supporting surface while splitting, and whereby the workman can easily reach the upper split shake from the operating station for movement to a bundling area.

6. The mill of claim 5, said control means including an operating handle at the operating station.

7. The shake mill of claim 5, said driving and releasing means including a reversible air motor having a shaft coupled to a set of sprockets, said flexible tension members including chains wrapped around the sprockets and wherein rotation of said sprockets in one direction pulls the splitting knife but rotation in the reverse direction slackens said chains whereby the workman can manually withdraw the splitting knife back to the operating station.

8. The mill of claim 5, including shake stacking bins of different sizes adjoining opposite sides of the operating station.

9. The method of splitting, trimming and stacking shakes from a pre-kerfed shake block at a single operating station comprising:

holding a pre-kerfed shake block at an operating station, manually guiding at the operating station a power driven splitting bar into the endmost kerf in the block, actuating the power at the operating station and driving the splitting bar through the block to split a shake, manually removing the split shake at the operating station, trimming the shake at the operating station, stacking the shake at the operating station in one of at least two bundles depending upon the size or quality of the trimmed shake, and returning the splitting bar to the operating station to repeat the splitting operation all from one operating location, said step of driving the splitting bar including pulling the splitting bar from its forward ends downwardly and horizontally through the block to maintain a seating force on the block while splitting.

10. The method of splitting, trimming and stacking shakes from a pre-kerfed shake block all at a single operating station comprising:

holding a pre-kerfed shake block at an operating station, manually guiding at the operating station a power driven splitting bar into the endmost kerf in the block, actuating the power at the operating station and driving the splitting bar through the block to split a shake, manually removing the split shake at the operating station, trimming the shake at the operating station, stacking the shake at the operating station in one of at least two bundles depending upon the size or quality of the trimmed shake, and returning the splitting bar to the operating station to repeat the splitting operation all from one operating location, said step of returning the splitting bar includes manually returning the splitting bar by the operator at the operating station.

11. The method of claim 10 said step of driving the splitting bar including pulling the splitting bar from its forward ends downwardly and horizontally through the block to maintain a seating force on the block while splitting.

* * * * *